US007316337B2

(12) United States Patent
Botham et al.

(10) Patent No.: US 7,316,337 B2
(45) **Date of Patent: *Jan. 8, 2008**

(54) DEVICE FOR DISCHARGING MOLTEN METAL FROM A CONTAINER

(75) Inventors: Brian W. Botham, Retford (GB); Gianni Zomero, Pasian di Prato (IT); Andrea De Luca, Remanzacco (IT)

(73) Assignee: Danieli & C.Officine Meccaniche S.p.A., Buttrio (IT)

( * ) Notice: Subject to any disclaimer, the term of this patent is extended or adjusted under 35 U.S.C. 154(b) by 420 days.

This patent is subject to a terminal disclaimer.

(21) Appl. No.: 10/520,578

(22) PCT Filed: Jul. 7, 2003

(86) PCT No.: PCT/EP03/07240

§ 371 (c)(1),
(2), (4) Date: Jan. 7, 2005

(87) PCT Pub. No.: WO2004/007122

PCT Pub. Date: Jan. 22, 2004

(65) Prior Publication Data

US 2006/0151140 A1 Jul. 13, 2006

(30) Foreign Application Priority Data

Jul. 10, 2002 (IT) ..... MI2002A01508

(51) Int. Cl.
*B22D 41/08* (2006.01)

(52) U.S. Cl. ..... 222/606; 222/607; 164/335

(58) Field of Classification Search ..... 222/606, 222/607; 164/335

See application file for complete search history.

(56) References Cited

U.S. PATENT DOCUMENTS

| | | | | |
|---|---|---|---|---|
| 3,833,050 | A | 9/1974 | Kashuba et al. | |
| 5,711,367 | A * | 1/1998 | Lauener | 222/606 |

FOREIGN PATENT DOCUMENTS

| | | |
|---|---|---|
| FR | 2 659 880 | 9/1991 |
| JP | 59073173 | 4/1984 |

* cited by examiner

*Primary Examiner*—Scott Kastler
(74) *Attorney, Agent, or Firm*—Sampson & Associates, P.C.

(57) ABSTRACT

A device for discharging molten metal from a container to another, comprising an outlet sleeve which penetrates into the lower container pushed by springs against a nozzle of refractory material which connects the inside of the upper container with the outside, so as to make a seal for the molten metal. The outlet sleeve is surrounded by a cylindrical sheath which joins, through a sand joint with a cylindrical blade fixed to the base of the upper container, around the aperture where it faces the nozzle. The sheath and the blade enclose a volume into which an inert gas is injected to remove the air possibly present.

11 Claims, 2 Drawing Sheets

DEVICE FOR DISCHARGING MOLTEN METAL FROM A CONTAINER

This application claims priority to PCT/EP2003/007240 entitled Device For Discharging Molten Metal From A Container, filed on 7 Jul. 2003, which claims priority to Italian Patent Application No. MI2002A001508, filed on 10 Jul. 2002.

FIELD OF THE INVENTION

The invention refers to a device for discharging molten metal from one container to another, from example from a ladle to a tundish or from a tundish to an under tundish for feeding a continuous casting line.

STATE OF THE ART

Normally, in continuous casting plants, the molten metal which originates, for example from an electric furnace, or from a converter, is subjected to a series of pouring passages between containers, prior to being cast in the ingot mould to form ingots, slabs, bars, strips and others.

A typical example is given by the application of the technology of continuous strip casting in which the steel emerging from the production oven is collected in a ladle, from which it is unloaded into one or more tundishes, each of which feeds one or more melts above two cooled, counter rotating casting rolls, which form the ingot mould in which the metal solidifies and emerges in the form of finished product, for example a strip, a bar or otherwise. Amongst the tundish and the ingot mould can also be envisaged an under tundish, from which the molten metal passes into the ingot mould.

It is known that the quality of the final product, and also the execution of the process itself can be compromised by the contact of air with the molten metal. For example, the oxygen of the air can combine with elements dissolved in the steel forming inclusions, which deteriorate the quality of the steel, as also with dissolved oxygen itself. In the case in which the steel is used in continuous casting, for example in a dual roller plant, the oxygen combined with the iron can produce scale which deposits on the rolls, locally altering, amongst others, the heat exchange, with serious consequences for the final product. Nitrogen can also cause the formation of precipitates which compromise the quality of the product.

In the containers into which the molten metal must pass there is generally maintained a protective atmosphere, generally through the feeding of an inert gas, for example argon.

The various passages of the metal from one container to another are critical, with regard to the problem of possible contamination with air, bearing also in mind that the various containers must be emptied in between, both for the normal movement during the metal production operation, as for example in the case of the tundishes, and to allow for the substitution of the parts in refractory material, such as for example the outlet sleeves through which the molten metal flows, which are subject to rapid wear and corrosion.

Discharging devices in the known art are not easy to operate and require delicate operations to allow the approaching of two containers for joining. Sometimes collisions produced during the coupling damage parts of the discharging device.

Therefore, the need is felt to provide a discharging device, to interpose between the various containers in which the molten metal passes, which allows avoiding contact between the air and the metal and which allows a rapid and precise coupling between the containers, in addition to a likewise rapid uncoupling.

SUMMARY OF THE INVENTION

It is therefore an aim of the present invention, to overcome the above mentioned problems by providing a device for discharging molten metal from a container which allows a rapid and precise coupling of the container to another container so as to constitute a conduit for the passage of the molten metal which avoids the contact of the metal with the air.

A further aim is that of providing a discharging device which allows a rapid, reliable and lasting coupling of the two containers, in the presence of molten metal at high temperature and which in addition is not is not prone to the impacts which occur during coupling of the containers.

The problems exposed above have been solved according to the main claim by means of a discharging device for molten metal between a first upper vessel and a second container placed below the first one in which said first container comprises a circular blade, fixed to the base of the first container around an aperture, a nozzle, inserted in said aperture with the lower extremity protruding from it and in which said second container comprises an outlet sleeve the upper extremity of which is suitable to be coupled with said lower extremity of the nozzle, elastic means for pushing said outlet sleeve upwards, a cylindrical sheath surrounding said nozzle and said elastic means, means of sealing gas between said sheath and said circular blade.

Generally, said outlet sleeve is placed with its vertical axis and penetrates into the lower container with its lower extremity, through an appropriately made hole in the cover of the latter. The sheath can be advantageously cylindrical, as with the blade, and be coaxial with the outlet sleeve, and be welded to the lower container, around said opening. Preferably said means for realising a gas seal are sand joints. The blade is preferably welded to the base of the upper container.

Coupling the lower extremity of the nozzle with that uppermost of the outlet sleeve one creates a channel which connects the interiors of the two containers. A force supplied by appropriate means guarantees sealing with respect to the molten metal.

LIST OF THE FIGURES

Further advantages of the present invention will become evident, to the skilled person, from the following detailed description of a particular embodiment given by way of non limiting example, of a discharging device with reference to the following figures, of which:

DETAILED DESCRIPTION OF A PREFERRED EMBODIMENT

Figure 1:
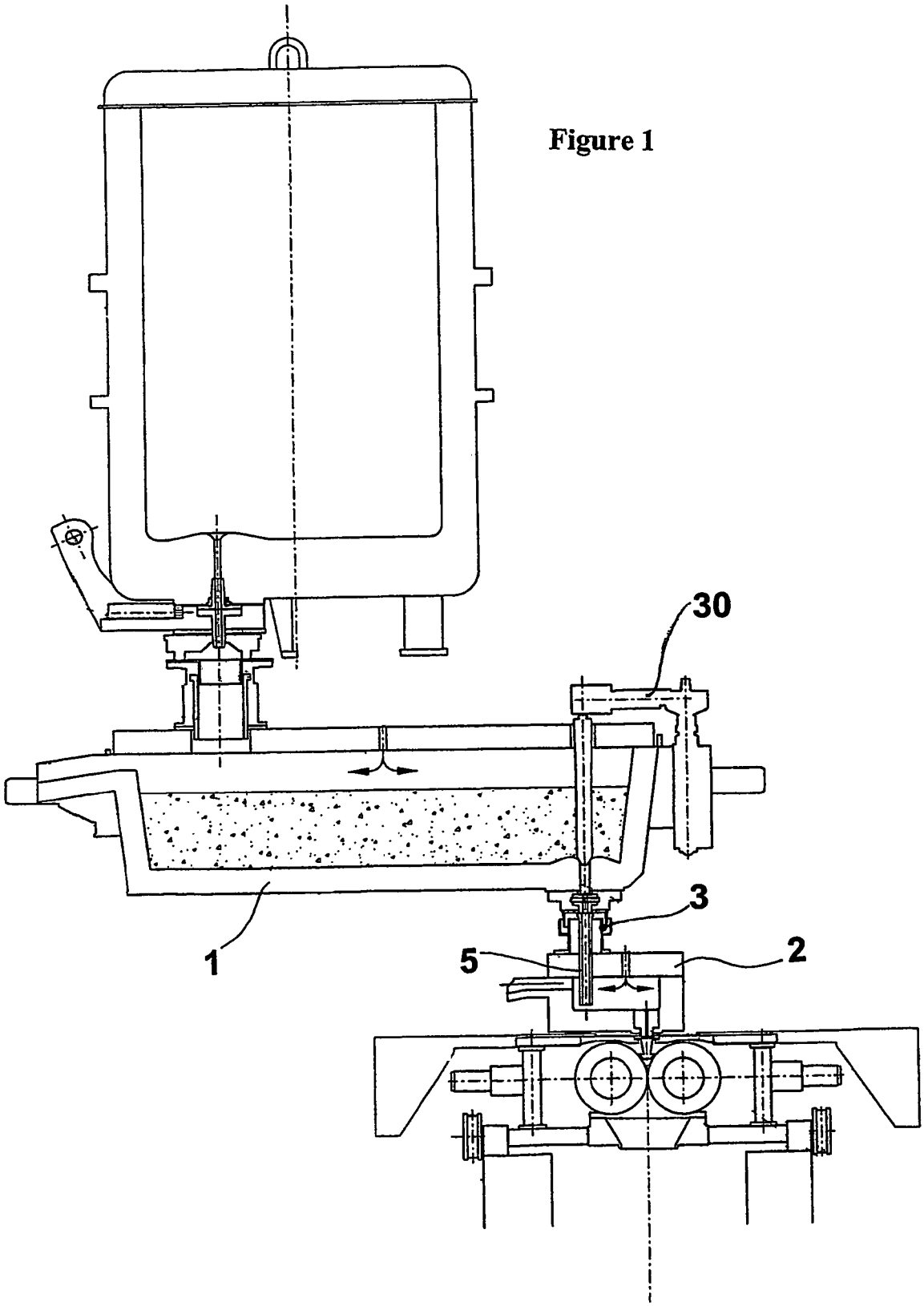
FIG. 1 shows a section of a casting plant in which is used a discharging device according to the present invention which connects a tundish with an under tundish.
Figure 2:
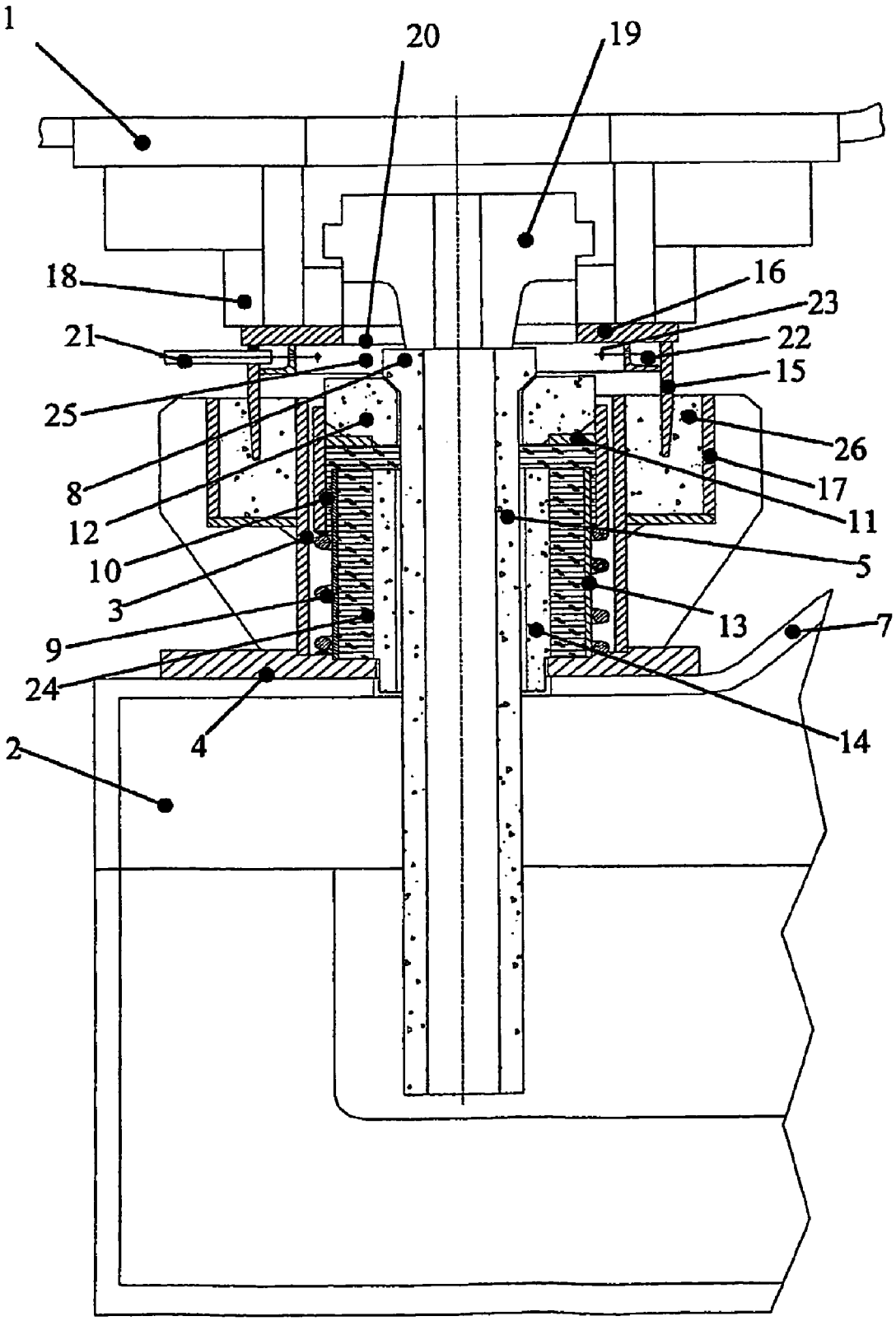
FIG. 2 shows an enlarged section of the discharging device according to the invention.

The cylindrical metal sheath 3, is welded to a plate 4 integral with the under tundish 2. The outlet sleeve 5 through the hole crosses the plate 4 and the upper walls 7 of the under tundish 2. The outlet sleeve 5 has a ring shaped protrusion 8 around its upper extremity. On the protrusion 8 act the means for pushing the outlet sleeve upwards and holding it vertically, comprising a helical spring 9, or equivalent elastic means, a metallic beaker 10, having internally a metallic ring shaped support 11 which holds a ring 12 of refractory material into which the outlet sleeve 5 inserted. The spring 9 reacting against the plate 4 acts on the beaker 10, pushing the latter upwards and thus also the outlet sleeve 5. A structure for centring the spring 9 and the beaker 10 can be envisaged. In the case in the figure it is represented by a metal cylinder 13, surrounded by the spring 9, and around which runs the beaker 10. A tube 14 of refractory material is fixed to it with a spacer of refractory material adequate 24, for the protection of the spring 9 and the cylinder 13 from heat. The outlet sleeve 5 can run in the tube 14, pushed by the spring 9. Preferably spring 9 and cylinder 13 are coaxial to the outlet sleeve 5. The beaker 10 can run on the cylinder 13.

The blade 15, Fixed to the plate 16, making part of the base 1 of the tundish, is cylindrical and is of shape and size such that its lower edge can penetrate into the ring shaped tank 17, filled with sand 26 or other appropriate material, said tank surrounding the upper edge of the sheath 3, thus realising a sand joint for the sealing of gas.

The structure 18, making part of the base 1 of the tundish, holds a nozzle 19 of refractory-material, the lower end of which faces the opening 20. The duct of the nozzle 19 connects the inside of the tundish 1 with the outside.

When the coupling placing the tundish 1 over the under tundish 2, is realised as indicated in FIG. 1, and at the same time forming a gas seal by sinking the ring shaped blade 15 into the sand 26, the spring 9 pushes the outlet sleeve 5 against the nozzle 19, thus forming a channel which connects the insides of the two containers, and a secure seal for the molten metal destined to flow through the channel.

It could be advantageous that the duct of the nozzle 19 is of an inferior diameter than the duct of the outlet sleeve 5.

The surfaces of the nozzle 19 and of the outlet sleeve 5 adapted to be coupled can have different appropriate shapes. According to a preferred aspect, they can be spherical surfaces, one concave and one convex, which allows the auto-alignment of the ducts of the nozzle 19 and the outlet sleeve 5 when coupling is made.

A tube 21 crosses the blade 15, said tube 21 being destined to feed-in gasses of appropriate composition, for example argon, inside the ring-shaped chamber 25 formed in the space enclosed by the blade 15 and the sheath 3 thanks to the sand joint. The gas has the aim to avoid the entry of air and to dilute and remove any residual air possibly entrapped. A gas distribution system, for example comprising a ring-shaped distribution chamber 22, formed between the blade 15 and the plate 16, can be envisaged in which the tube 21 introduces the gas and possesses a series of holes 23 to distribute it uniformly all along the circumference of the device. Alternatively, more feeling tubes along the perimeter of the blade can be envisaged 15. If deemed appropriate, gas feeding tubes which cross the sheath 3 or other parts of the device can be envisaged.

The characteristics of the spring 9 are advantageously selected so as to have force to push the outlet sleeve 5 against the nozzle 19 adequate to the requirements. The weight of the outlet sleeve 5 holds it in position also when the coupling between the containers is not realised.

With a device such as that represented, the passage of molten metal can be regulated or blocked by a standard system buffer shaft 30 present in the upper container. With appropriate skill the device of the invention can be adapted for different discharging systems, such as that of the three plate box. It should be clarified that the base of the upper container can also comprise other elements, in addition to these described above, such as, in fact a box discharging system, of the type in which a mobile hold plate of refractory material is interposed between two fixed hold elements, for example two nozzles. The movement of the plate aligns or hides the hole to the ducts of the nozzles, closing or opening the passage to the molten metal. In such a case, the ring shaped blade can be fixed to the base of the box discharging system and the lower nozzle of it is adapted to be coupled with the outlet sleeve of the lower part of the device according to the invention.

The invention claimed is:

1. A molten metal discharging device between a first upper container (1) and a second container placed below the first container wherein said first container comprises a ring shaped blade (15), fixed to the base of the first container around a molten metal discharging aperture (20), a nozzle (19), inserted into said aperture with the lower end protruding from it and in which said second container (2) comprises an outlet sleeve (5) the upper end of which is suitable for being coupled with said lower end of the nozzle (19), elastic means (9, 10, 11, 12) adapted to push said outlet sleeve upwards, a cylindrical sheath (3) surrounding said outlet sleeve (5) and said elastic means, gas sealing means (17) between said sheath (3) and said ring shaped blade (15), wherein the cylindrical sheath (3) is integral with the second container (2) and said elastic means (9, 10, 11, 12) are adapted to react against the second container (2) so as to push upwards the outlet sleeve (5).

2. The device according to claim 1 wherein in the operating position of coupling between said first and second containers, said sheath (3) and said ring shaped blade (15) delimit a ring shaped gas tight chamber (25).

3. The device according to claim 2 wherein there are provided gas supplying means (21) for supplying gas to the interior of said ring shaped chamber.

4. The device according to claim 1 wherein said nozzle (19) and said outlet sleeve (5) are of refractory material.

5. The device according to claim 1 wherein said blade (15) and said sheath (3) are coaxial with said outlet sleeve (5).

6. The device according to claim 1 wherein said elastic means (9, 10, 11, 12) comprise a helical spring which imposes a force in the axial direction on the outlet sleeve (5).

7. The device according to claim 6 wherein said spring (9) is coaxial with the outlet sleeve (5) and a beaker (10) is interposed between the spring itself and the outlet sleeve (5), wherein a force is transmitted by the spring to the outlet sleeve (5) through said beaker.

8. The device according to claim 1 wherein said outlet sleeve (5) penetrates inside the lower container.

9. The device according to claim 1 wherein said gas sealing means (17) between said sheath and said blade comprise a sand joint.

10. The device according to claim 1 wherein a duct of said nozzle (19) has a diameter inferior to that of a duct of said outlet sleeve (5).

11. The device according to claim 3 wherein said gas supplying means (21) comprise a tube which crosses said blade (15) and a ring shaped distribution chamber (22).

* * * * *